US005322700A

United States Patent [19]

Drake et al.

[11] Patent Number: 5,322,700

[45] Date of Patent: Jun. 21, 1994

[54] TEA BAG WITH STRENGTHENED CENTERFOLD

[75] Inventors: Stephen P. Drake, Glen Rock; Vinod K. Bansal, Edison, both of N.J.

[73] Assignee: Conopco, Inc., Englewood Cliffs, N.J.

[21] Appl. No.: 982,778

[22] Filed: Nov. 30, 1992

[51] Int. Cl.[5] ..... B65D 75/20; B65B 29/02; B65B 51/10

[52] U.S. Cl. ..... 426/79; 426/77; 426/394; 426/410; 383/107; 493/394; 493/941; 53/376.2; 53/371.7; 206/0.5

[58] Field of Search ..... 426/394, 410, 77-84; 156/581, 582, 220; 493/394, 941, 390, 920, 302; 206/0.5; 383/107; 53/376.2, 371.7

[56] References Cited

U.S. PATENT DOCUMENTS

| | | | |
|---|---|---|---|
| 2,048,895 | 7/1936 | Rosen | 493/390 |
| 2,175,031 | 10/1939 | Salfisberg | 493/394 |
| 2,188,222 | 1/1940 | Hibbs | 493/390 |
| 2,208,951 | 7/1940 | Tamassy | 426/394 |
| 2,272,473 | 2/1942 | Noll | 493/390 |
| 2,281,582 | 5/1942 | Irmscher | 426/394 |
| 2,307,998 | 1/1943 | Eaton | 426/77 |
| 2,328,017 | 8/1943 | Irmscher | 426/394 |
| 2,328,018 | 8/1943 | Irmscher | 426/394 |
| 2,362,459 | 11/1944 | Barnett | 426/82 |
| 2,362,460 | 11/1944 | Barnett | 426/394 |
| 2,386,993 | 10/1945 | Valdastri | 426/283 |
| 2,413,686 | 1/1947 | Barnett | 426/394 |
| 2,447,014 | 8/1948 | Irmscher | 426/394 |
| 2,447,754 | 8/1948 | Hirschhorn | 426/394 |
| 2,593,608 | 4/1952 | Rambold | 426/79 |
| 2,786,761 | 3/1957 | Weisman | 426/77 |
| 2,925,171 | 2/1960 | Eaton | 426/83 |
| 3,053,665 | 9/1962 | Irmscher | 426/394 |
| 3,223,229 | 12/1965 | Welin-Berger | 426/79 |
| 3,653,913 | 4/1972 | Rambold | 426/83 |
| 3,774,369 | 11/1973 | Klar | 426/394 |
| 3,969,873 | 7/1976 | Klar | 426/394 |

FOREIGN PATENT DOCUMENTS

| | | | |
|---|---|---|---|
| 660916 | 7/1938 | Fed. Rep. of Germany | 426/83 |
| 2120270 | 11/1972 | Fed. Rep. of Germany | 426/83 |

*Primary Examiner*—Steven Weinstein
*Attorney, Agent, or Firm*—Brumbaugh, Graves, Donohue & Raymond

[57] ABSTRACT

A double-chamber tea bag has a centerfold that is crimped by squeezing it between a toothed wheel and a plain wheel and a headfold in which the front chamber has a flap that folds over the part of the end of the front chamber between triangular folds at each corner.

4 Claims, 2 Drawing Sheets

TEA BAG WITH STRENGTHENED CENTERFOLD

BACKGROUND OF THE INVENTION

The present invention relates to a tea bag and to a method and apparatus for making it. In particular, the invention concerns a tea bag of the type having two chambers containing comminuted tea that is made by forming a strip of filter paper into a flattened tube, cutting the tube to length, folding the tube intermediate its ends along a W-fold to form two chambers, and joining the ends of the chambers by a headfold. Tea bags of this type are well-known and have been marketed for about 40 years. For example, Thomas J. Lipton Co. sells such tea bags under the trademark "FLO-THRU®." For convenience, this type of tea bag will be referred to herein as a "double-chamber" tea bag.

Double-chamber tea bags are produced by special machines, of which there are several manufacturers. One of the main suppliers is a German firm, Teepak, GmbH, which sells a machine known as the "Constanta." The Constanta and similar machines produce double-chamber tea bags by depositing measured masses of comminuted tea in spaced apart locations along the length of a strip of filter paper at a first station. The filter paper strip is then advanced through mechanisms that form it into a flattened tube by folding in portions along each side and bringing the edges together face to face with a band along one edge of the strip extending beyond the other edge of the strip. The extending band is folded over the other edge to form a loop, and the loop is folded over, thereby forming a doubly folded joint between the edges of the strip in which one edge is singly folded over, the other edge is doubly folded and the extending band is captured in a loop of the first edge. The doubly-folded joint, which is called a "centerfold," is crimped by moving the tube between a pair of wheels having serrated surfaces in the form of transverse, projecting teeth. The wheel that engages the side of the centerfold opposite from the folded over edges has a width approximately equal to the width of the centerfold. The wheel that engages the folded edges is somewhat narrower than the centerfold. The teeth are designed to mesh, such that they tend to form corrugations in the centerfold. The narrow toothed wheel is spring-loaded toward the wide toothed wheel to apply pressure to the centerfold and cause the fibers of the several layers that constitute the centerfold to intertwine and form mechanical bonds between the adjacent layers.

One problem with presently known double-chamber tea bags is that the centerfold occasionally comes apart when the tea is being made, thereby releasing some of the tea from the bag. The failure of the centerfold, which does not happen very often but is aggravating to the consumer when it does, generally results from a sudden build-up in the pressure of air in the bag due to heating of the air when hot water is poured onto it, usually accompanied by a mechanical force resulting from impingement of a water stream on the bag.

Another problem with double-chamber tea bags involves release of tea from the front chamber of the bag at the headfold, again due to an air pressure increase and the force of a water stream. The headfold of previously known double-chamber tea bags is produced by positioning an end portion of the front chamber back to back against an end portion of the back chamber such that a band adjacent the end of the rear chamber extends beyond the end of the front chamber. Triangular segments at each corner of both chambers adjacent their ends are folded over along respective coincident diagonal fold lines such the triangular segments overlie portions of the front chamber externally. The extending band of the rear chamber is folded over along a transverse foldline to form a flap that overlies portions of the triangular segments externally. A portion of the end of the front chamber between the diagonal folded segments is not folded and is merely covered but not effectively closed by the folded over flap of the rear chamber. Tea can escape from the open portion along the end of the front chamber.

SUMMARY OF THE INVENTION

One object of the present invention is to provide an improved double-chamber tea bag that is significantly less likely than previously known bags to allow tea to be released from the bag when it is used. In particular, it is desired, first, to strengthen the centerfold so that it is less likely to break open and, second, to improve the headfold so that the front chamber is more effectively closed and more securely held closed. Another object is to enable the improved bags to be manufactured without any major changes in existing machines or the process that they carry out. Accordingly, the improved bags can be made with only a small investment of capital and with virtually no lost production due to downtime for modifying the existing machines.

According to one aspect of the invention, the strength of the centerfold is considerably improved by crimping it between a serrated wheel and a plain wheel, one of which is resiliently biased toward the other. Preferably, the serrated wheel is engaged with the side of the joint away from the folded edges, and the plain wheel is engaged with the side of the joint having the folded edges. Thus, the present invention includes an improvement in the structure of the bag centerfold and in the method by which the centerfold is made.

The improved bag can be made on existing machines by merely replacing the front serrated crimping wheel with a plain wheel, and the present invention, according to another aspect, includes the improvement in the machine of providing a plain front crimping roll, which is, preferably, somewhat wider than the previously known front serrated wheel.

The present invention also involves, preferably, an improvement in the headfold. In particular, a transverse band adjacent the end of the front chamber is folded over along a transverse foldline coincident with the transverse foldline of the rear chamber, thereby closing the opening at the end of the front chamber in the center segment between the triangular folds. Preferably, the staple that is conventionally provided to secure the headfold and fasten a string to the bag is located so that it extends through the folded over band of the front chamber and thereby secures the folded over band of the front chamber in its folded condition.

For a better understanding of the invention, reference may be made to the following description of an exemplary embodiment, taken in conjunction with the accompanying drawings.

DESCRIPTION OF THE EMBODIMENT

Figure 1:
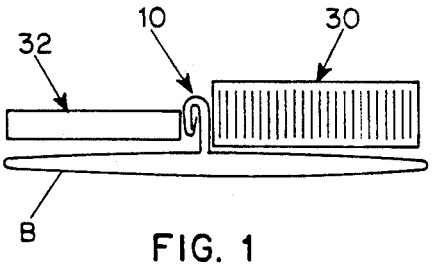
FIG. 1 is a generally schematic end view of the crimping station of a machine for making double-chamber tea bags that embodies an improvement according to the present invention.
Figure 2A:
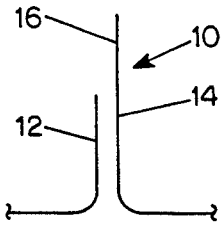
FIGS. 2A, 2B and 2C are fragmentary end cross-sectional views, on an larger scale than FIG. 1, illustrating the sequence of steps involved in forming the centerfold of a tea bag embodying the present invention.
Figure 2B:
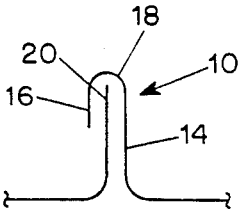
Figure 2C:
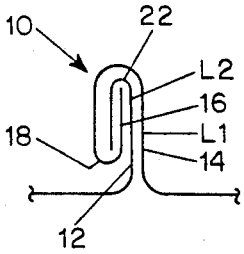
Figure 3:
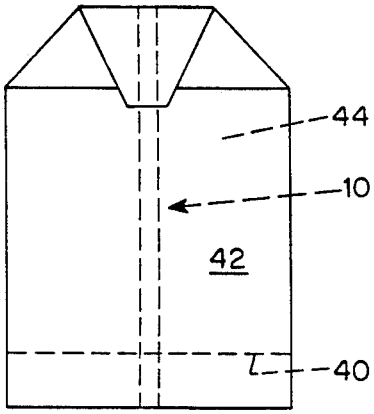
FIG. 3 is a front elevational view of a tea bag embodying the present invention.

Double chamber bags have long been produced by feeding to a machine from a supply roll a strip of filter paper having a width somewhat wider than twice the width of the tea bag. Two measured amounts of comminuted tea are deposited along the center of the strip at longitudinally spaced-apart locations at a first station. The strip is then formed into a flattened tube (see FIG. 1) by folding portions along each side of the strip over the center portion of the strip and forming a longitudinal centerfold 10 between the edges. To form the centerfold, portions 12 and 14 along the edges of the strip are placed together face to face with a band 16 along one edge portion 14 of the strip extending beyond the end of the other edge portion 12 (FIG. 2A). The extending band 16 is folded over the edge portion 12 (FIG. 2B) to form a loop 18 over a band 20 of the edge portion 12. The loop 18 and band 20 are folded over (FIG. 2C) to form a joint between the edge portions of the strip in which the edge portion 12 is singly folded to form a loop 22, the edge portion 14 is doubly folded, and the extending band 16 of the edge portion 14 is captured in the loop 22 of the portion 12.

In the machine as previously known and used, the centerfold is mechanically crimped by moving it lengthwise between a back wheel and a front wheel. Each wheel has on its peripheral surface transversely extending, outwardly projecting spaced-apart teeth, the teeth being configured so that-they mesh. The front wheel is biased by a spring toward the back wheel, and the resulting squeezing pressure applied by the wheels to the joint causes some of the fibers of each layer of the filter paper to intertwine with the fibers of each adjacent layer in the joint, thereby mechanically linking the sheets and stabilizing the joint. The squeezing pressure can be adjusted and, in practice, is adjusted to be as large as possible but not so large as to produce localized tearing of the paper. In this regard, the meshing of the teeth tends to stretch and tear the paper because of the elongating effect of the tendency of the wheels to form corrugations.

According to one aspect of the present invention, the toothed front wheel of the machine is replaced by a plain front wheel. In particular, the improved machine, as shown in FIG. 1, includes the original toothed back wheel 30 and a plain front wheel 32, i.e., a wheel having a smooth peripheral surface. The front wheel 32 in the modified machine should also be wider than the toothed wheel-that it replaces; the plain wheel of the invention should have a width of from about 1.0 to about 2.0 mm., preferably 1.5 mm. The original toothed front wheel has a width of 0.75 mm. In operation, the plain wheel squeezes the doubly-folded joint against the back wheel, thereby applying pressure between the paper layers of the joint. The pressure is concentrated at the tips of the teeth of the back wheel 30 and is greatest in the layers of the joint that are closest to the toothed back wheel 30. The layers closest to the front wheel, being more remote from the teeth, are isolated from the teeth by the layers closer to the teeth. As a result, the bonds between the adjacent layers are strongest in the two layers of the joint that are closest to the walls of the bag, which are labelled L1 and L2 in FIG. 2C. Because any opening up of the joint must begin by separation of the layers L1 and L2 from each other, the stronger bond between the layers L1 and L2 results in a centerfold having a greater strength. It has been found, surprisingly and remarkably, that a centerfold made in accordance with the present invention is more than twice as strong as the previously known centerfold.

It is believed that the greater strength of the centerfold of the present invention results, at least partly, from the fact that there is little stretching of the paper when the joint is crimped. With the previously used intermeshing toothed wheels, the paper is stretched lengthwise along the joint, because the teeth tend to form corrugations. On the other hand, the layer-to-layer pressures applied by the teeth are believed to be considerably less in the previous method than with the method of the present invention. With the invention, the machine can be run with a higher spring force on the plain wheel, the effect of which, though partly offset by the greater width of the front wheel, is a greater layer-to-layer pressure and, hence, a greater tendency to cause intertwining of the fibers of the adjacent layers, especially of the layers L1 and L2.

Figure 4A:
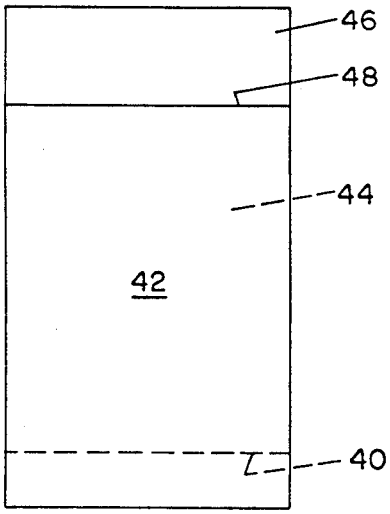
FIGS. 4A to 4D are front views illustrating the steps of a method of making the headfold of a tea bag according to the present invention.
Figure 4B:
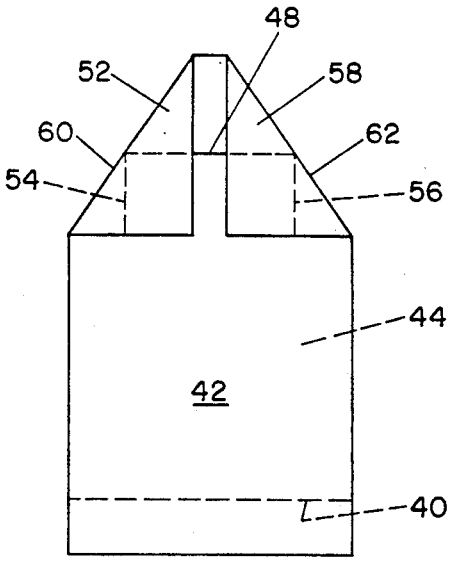
Figure 4C:
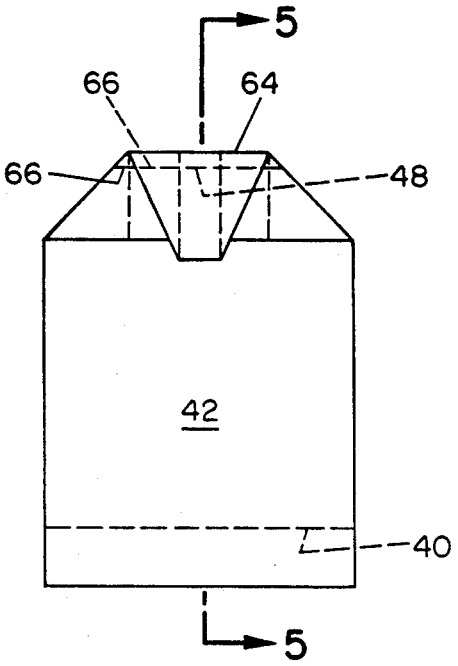
Figure 4D:
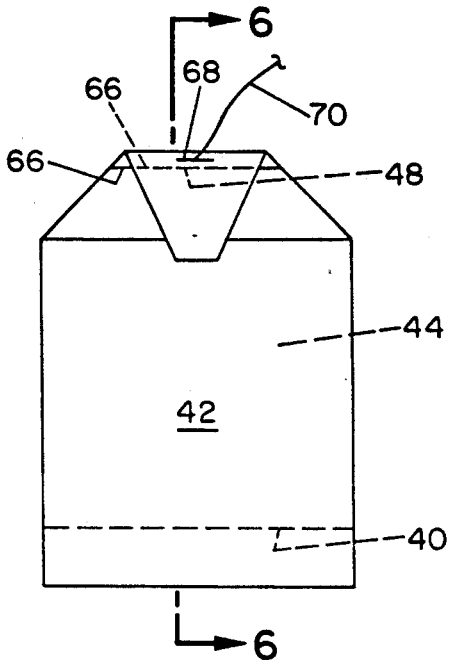
Figure 5:
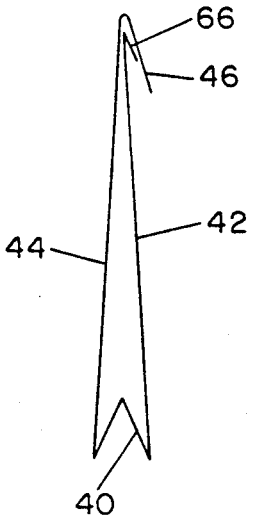
FIGS. 5 and 6 are cross-sectional views taken along the lines 5—5 and 6—6 of FIGS. 4C and 4D, respectively.
Figure 6:
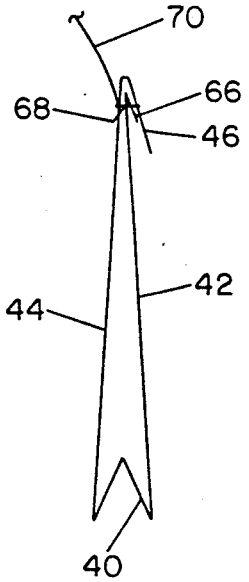

Following crimping of the centerfold, the strip is advanced, and the machine cuts off from the strip a segment that will make up a single bag, forms a W-fold 40 near the lengthwise center of the segment, and positions a front chamber 42 of the bag back to back with a rear chamber 44, locating the centerfold between the chambers and the smooth chamber walls facing out and leaving a transverse band 46 along the edge of the rear chamber extending beyond the edge 48 of the front chamber (FIG. 4A). (For clarity of illustration, the chambers are shown in FIGS. 5 and 6 by single lines, it being apparent that each chamber has an external smooth wall and an internal wall that contains a segment of the centerfold; also, the centerfold is not shown in FIGS. 4 to 6.) Triangular segments 52, 54 and 56, 58 at each corner of both chambers adjacent the ends thereof are folded over along respective coincident diagonal fold lines 60, 62 such that the segments 54, 58 and portions of the segments 52, 56 overlie the front chamber externally (FIG. 4B). The extending band 46 of the rear chamber is folded over along a transverse foldline 64 to overlie portions of the triangular segments externally. The foldline 64 is located such that a transverse band 66 adjacent the edge of the front chamber between the triangular segments 54, 58 is folded over under the band 46. To band 66 forms a flap that closes the segment of the end of the front chamber between the folded-over triangular segments 54, 58. A staple 68 is installed through both chambers closely adjacent the transverse foldline 64 so that it passes through the flaps formed by the folded over bands 46 and 66. The staple secures the ends of the chambers in closed condition and joins them together. The staple also fastens one end of a string 70 to the bag.

The headfold at the ends of the chambers can be produced on the machine without any modification of its construction. The setup of the machine is altered so that the size and location of the W-fold are slightly changed to position the end of the front chamber closer to the end of the back chamber (FIG. 4A) prior to making the folds. Accordingly, when the transverse fold 66 is made to form the flaps, the band 66 of the front chamber is folded over with the band 46 of the back chamber.

The folded over flap (the band 66) of the front chamber closes the otherwise open end in the segment that extends between the diagonal corner folds, thus better ensuring against escape of tea from the front chamber. Also, the flap adds an additional layer of paper along the end of the headfold, which makes the headfold stiffer and less prone to deformations that might otherwise allow an opening to form through which some tea might escape from the bag.

We claim:

1. In a tea bag made from a strip of filter paper that is formed into a tube by folding in and joining its edges by a doubly folded and mechanically crimped longitudinal centerfold, a length of the tube being cut from the strip and folded endwise intermediate its ends along a transverse W-fold to define a front chamber and a rear chamber, each of which contains comminuted tea, and the ends of the chambers being joined by a headfold that forms an end closure for each chamber and a connection between the chambers, the improvement wherein the doubly folded centerfold is mechanically crimped by moving it between a serrated wheel and a plain wheel, one of which is resiliently biased toward the other to engage the centerfold under pressure between the serrations of the serrated wheel and the surface of the plain wheel and squeeze the doubly folded centerfold, applying sufficient pressure to cause intertwining of the fibers of the adjacent layers of filter paper, mechanically linking the layers of the centerfold so that the centerfold is less likely to break open while the tea bag is being used compared to a tea bag having a center fold joined by squeezing it between two serrated wheels.

2. In a tea bag according to claim 1 and in which the centerfold is formed by juxtaposing portions along the edges of the strip face to face with a band along one edge of the strip extending beyond the other edge of the strip, folding the extending band over said other edge to form a loop, and folding the loop over to form a joint between the edges of the strip in which said other edge is singly folded and said one edge is doubly folded and the extending band is captured in a loop in said other edge, the improvement wherein the centerfold is crimped by engaging the serrated wheel with the side of the joint away from the folded edges and engaging the plain wheel with the side of the joint having the folded edges.

3. In a tea bag according to claim 1 in which the headfold is formed by positioning an end portion of the front chamber back to back against an end portion of the back chamber such that a band adjacent the end of the rear chamber extends beyond the end of the front chamber, folding in triangular segments at each corner of both chambers adjacent the ends thereof along respective coincident diagonal fold lines to overlie the front chamber externally, and folding the extending band of the rear chamber along a transverse foldline to overlie portions of the triangular segments externally, the improvement wherein a transverse band adjacent the end of the front chamber is folded over along a transverse foldline coincident with the transverse foldline of the rear chamber to form a flap that closes the segment of the end of the front chamber between the triangular segments.

4. In a tea bag according to claim 3 and in which the headfold further includes a staple extending through both chambers closely adjacent the transverse foldline, the improvement wherein the staple extends through the folded over flap of the front chamber.

* * * * *